United States Patent [19]

Allen

[11] 3,945,189

[45] Mar. 23, 1976

[54] METHOD OF PRODUCING KNOP YARN

[75] Inventor: Lindsay Alfred Allen, Highton, Australia

[73] Assignees: I.W.S. Nominee Company Ltd, London, England; Commonwealth Scientific & Industrial Research Organization, Canberra, Australia

[22] Filed: Mar. 15, 1974

[21] Appl. No.: 451,779

[30] Foreign Application Priority Data

Mar. 16, 1973 United Kingdom ..... 12676/73

[52] U.S. Cl. ..... 57/160; 57/12; 57/91; 57/140 J; 57/144

[51] Int. Cl.[2] ..... D02G 3/34

[58] Field of Search ..... 57/12, 91, 90, 140 BY, 57/140 J, 144, 160, 106

[56] References Cited

UNITED STATES PATENTS

| | | | |
|---|---|---|---|
| 2,211,641 | 8/1940 | Bry | 57/144 |
| 2,211,642 | 8/1940 | Bry | 57/144 |
| 2,211,643 | 8/1940 | Bry | 57/144 |
| 2,279,297 | 4/1942 | Bry | 57/144 |
| 2,309,095 | 1/1943 | Bry | 57/144 |
| 2,731,789 | 1/1956 | Holder | 57/160 |
| 3,334,483 | 8/1967 | Radcliffe | 57/140 BY |
| 3,763,640 | 10/1973 | Nagel et al. | 57/144 X |

*Primary Examiner*—John Petrakes
*Attorney, Agent, or Firm*—Harold L. Stowell

[57] ABSTRACT

Fancy yarns such as knop or stripe yarns are produced by supplying an effect yarn or roving to a foundation yarn or roving during the operation of spinning but before the foundation yarn reaches the twisting spindle. The effect yarn is kept under a tension which is adjusted to cause the yarn to oscillate with respect to the foundation yarn. Oscillation builds up layers of effect yarn at intermittently spaced locations along the foundation yarn which constitute irregular knops or stripes on the yarn. The twist of the effect yarn in the finished fancy yarn will be found to reverse with each succeeding layer in the knop. The invention enables fancy yarns to be readily produced on ordinary spinning frames without the provision of interrupted feeds or other special features on the frame.

4 Claims, 1 Drawing Figure

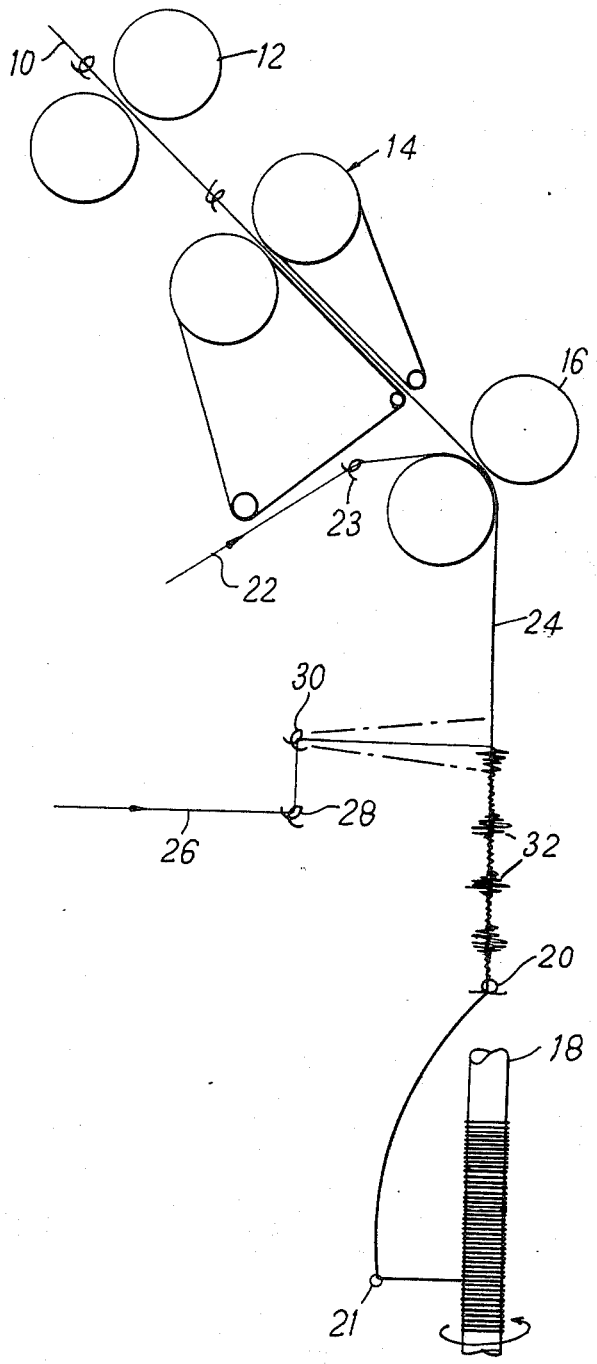
10
12
14
16
23
22
24
30
28
26
32
20
18
21

METHOD OF PRODUCING KNOP YARN

This invention relates to a method of forming fancy yarns, such as knop or stripe yarns, and to the yarns formed thereby.

Knop and stripe yarns are forms of fancy yarns and are defined in "Textile Terms and Definitions", fifth edition published by the Textile Institute.

Knop yarns are normally made in a fancy twisting frame. Two yarns, a 'foundation' and an 'effect ' yarn, are fed via independently operable pairs of rollers to a single twisting spindle, the yarns meeting and twisting together some distance above the twisting spindle. The rollers controlling the foundation yarn are intermittently stopped while the rollers controlling the effect yarn are operated continuously. The foundation yarn continues twisting even when it is not moving forward and this has the effect of causing the effect yarn to wrap around it at one point forming a knop. The position at which the effect yarn joins the foundation yarn is controlled by a knopping bar placed below the rollers and above the spindle, over which bar the effect thread passes. The knop yarn so made may be bound with a further thread or yarn in the reverse direction to the initial stage to secure the knops which are not stable to mechanical action.

Defined broadly, the present invention provides a method of producing a fancy yarn which comprises passing a foundation yarn from a feeding mechanism to a twisting spindle and feeding an effect yarn onto the foundation yarn at a point between the feeding system and the spindle, the effect yarn being held at a tension which causes it to oscillate with respect to the foundation yarn.

The foundation yarn may be a yarn fed from the rollers of a conventional twisting frame, in which case a knop yarn can be produced without needing a fancy twisting frame.

According to a further aspect of the present invention, a method of producing a knop or stripe yarn on a spinning frame comprises spinning a foundation yarn from a drafting system onto a twisting spindle and feeding an effect yarn onto the foundation yarn at a point between the drafting system and the spindle, the effect yarn being held at a tension which causes it to oscillate with respect to the foundation yarn.

The preferred yarns used in the process of the invention are wool yarns, but any textile which is spun and any effect yarn may be used.

According to the present invention there is also provided a knop or stripe yarn which comprises a spun foundation yarn having spaced irregular knops or stripes of effect yarn formed thereon, the knops or stripes consisting of a plurality of layers of effect yarn wrapped about a portion of the foundation yarn each successive layer of effect yarn having an opposite twist to the previous layer.

A preferred form of knop yarn of the invention has knops principally consisting of three layers of effect yarn.

The invention will be described further, by way of example, with reference to the accompanying drawing in which the sole FIGURE is a diagrammatic side elevation of the last stage of a spinning frame operating a process embodying the invention.

Wool worsted roving 10 is passed through the nip of a pair of first drafting rollers 12. The roving 10 is guided and controlled by apron rollers 14 and passes through a second pair of drafting rollers 16. The rollers 12, 14 and 16 form a conventional double apron drafting system. After leaving rollers 16 the roving is spun onto a twisting spindle 18 via a yarn guide pigtail or pot-eye 20 and traveller 21. The second drafting rollers 16 are set run at about twenty times the speed of rollers 12 to produce a fine yarn, and in order to prevent the wool from parting a nylon multi filament 22 is introduced to the wool roving just prior to the rollers 16 via an eyelet or pigtail 23, to add strength to the resultant yarn.

On leaving the drafting rollers 16, the roving 10 is in the process of being spun into a yarn 24 which will be the foundation yarn of the final knop yarn. As the foundation yarn 24 passes from the drafting rollers 16 to the pigtail 20, an effect yarn 26 is twisted onto the foundation yarn. The effect yarn 26 is of a similar type to the foundation yarn but may be of a different colour. The effect yarn 26 passes through two pigtails 28, 30 which are adjustable relative to one another to control the tension of the effect yarn.

The foundation yarn 24 leaving the drafting rollers 16, which operate continuously, is of course being twisted by the rotation of the spindle 18 and the effect yarn 26 is therefore wrapped round it. However as the effect yarn 26 has the same direction of twist (e.g. a Z twist) as the foundation yarn 24 it tends to twist the effect yarn further causing "snarls" and alterations in tension with the effect that it oscillates irregularly through an angle as shown in the FIGURE and consequently deposits irregular lumps (knops) 32 on the foundation yarn 24.

Although in the example described above reinforced wool worsted core yarn is employed as the foundation yarn it will be appreciated that any yarn that is spun may be used as the foundation yarn, although a core yarn is preferred when the process is operated on a spinning frame. Similarly, the effect may be of any type and may be of the same type as or a different type from the foundation yarn. Likewise the colour of the effect yarn may be the same as or different from that of the foundation yarn depending upon the type of knop yarn it is desired to produce.

The type of knop or stripe yarn produced is dependent upon several factors. The distance between the pigtail 30 and the effect yarn 24 determines the average length of the knops or stripes as this distance controls the angle through which the effect yarn can oscillate.

The amount of twist of both the effect and foundation yarns also affects the type and size knops or stripes formed.

The tension of the effect yarn is also critical but can readily be adjusted by simple trial. Too high a tension will result in the effect yarn being evenly twisted onto the foundation yarn producing a homogeneous colour twist type yarn. Too low a tension will produce large, loose knops which are not mechanically stable, i.e. they can easily be moved with respect to the foundation yarn.

When the tension is in the optimum range a knop or stripe consisting of about three lengths of effect yarn overlying and twisted in with the foundation yarn is produced. Such knops are stable to mechanical action and do not need to be bound with a further thread. It has been found that the tension may be adjusted within the correct range by using a pair of pigtails or eyelets, such as pigtails 28, 30, to alter the angular path through which the effect yarn travels.

When the tension is in the operative range the knops are formed by the effect yarn wrapping round the foundation yarn first with the direction of twist of the foundation yarn, and then the effect yarn snarls and reverses its direction of travel with respect to the foundation yarn, giving a second layer covering the first with the opposite direction of twist. Finally the foundation yarn again revises its direction of travel and the two layers are covered by a third layer of effect yarn winding with the original direction of twist.

It will also be noted that the effect yarn is preferably fed substantially at right angles to the foundation yarn whereas in the conventional knopping bar method the effect yarn is fed to the foundation yarn at an acute angle. The perpendicular feed allows the effect yarn to oscillate evenly up and down the foundation yarn.

An important advantage of the process of the invention is that it eliminates the need for a separate operation on a fancy twisting frame to produce a knop yarn. The knop yarn can be produced on the spinning frame as the foundation yarn is being spun. Furthermore it is unnecessary to bind the knop yarns of the invention. The invention therefore produces considerable economies both in reducing the number of process steps and eliminating the need for a fancy twisting frame.

The knop yarn of the invention does not need to be twisted with a further yarn or yarns as it is strong enough for knitting or weaving without additional twofolding.

The knop yarn produced according to the invention has knops randomly distributed along its length. The length of individual knops or stripes also varies but the average length may be controlled as described above.

In the embodiment described the effect yarn had the same direction of twist as the foundation yarn, i.e. Z twist. However if the effect yarn has S twist and the foundation yarn Z twist a knop will still be produced. In this case the twisting of the foundation yarn will tend to untwist the effect yarn and less snarls, and therefore less knops per unit length, will be produced. Furthermore the knops produced will be more fluffy as the effect yarn will be at least partially untwisted.

When using a wool foundation yarn on a spinning frame it is preferred to use a reinforcing thread as described above, i.e. a core yarn, as otherwise the additional tensions introduced by the winding of the effect yarn may lead to breakage of the foundation yarn.

The draft setting of the spinning frame is not critical and is chosen to give a suitable foundation yarn count for the roving used. The twist setting should be such as to give a yarn sufficiently bound together and with enough twist to produce adequate knops. The traveller weight and spindle speed are chosen by normal criteria to give efficient running conditions.

Another suitable path for the effect yarn is from a supply package then down over the front of the drafting unit over the top of the front drafting roller to join the foundation yarn as before. In this case a suitable guide, e.g. a pigtail, is required to keep the yarn located above the front drafting roller. If necessary the effect yarn tension can be increased by increasing the wrap of the effect yarn round this guide or by any other suitable means.

There are several variations of this basic technique which yield yarns of different character. For example, two differently coloured effect yarns can be applied to the one foundation yarn. If both effect yarns are applied to the foundation yarn at the same point then a yarn with compact knops of two colours is formed. If the effect yarns are fed onto the foundation yarn at two points which are suitably separated then the yarn formed will have knops of the colour of yarn fed first onto the foundation yarn overlaid by the effect yarn fed last onto the foundation yarn. It is also possible to obtain a yarn in which each coloured yarn alternates in a random fashion as the topmost yarn. This last situation occurs when the points of application of the effect yarn onto the foundation yarn are close together but the yarns are kept separate so that they do not twist and feed on together.

Yet another variation can be produced by feeding the effect yarn onto the foundation yarn below the pot-eye, or yarn guide, immediately above the spindle. In this case the knops formed are shorter in length, approximately 1 cm or less, and more frequent in distribution. It may be necessary to provide another guide near the pot-eye so that the effect yarn and foundation yarn do not twist together above the pot-eye and thus cause a yarnbreak.

An example of the basic type of knop yarn is as follows:

Foundation yarn — core yarn 19 tex resultant count:
14 tex wool dyed black.
Nylon 50 d.tex, 15 filaments.
Yarn twist 726 t.p.m. Z.
Effect yarn — 37 tex, Z twist, orange.
Resulant knop yarn — 70 tex, black/orange twisted yarn with orange knops.

In the above example it will be noted that the count of the resultant knop yarn (70 tex) exceeds the combined count (56 tex) of the foundation and effect yarns which is, of course, due to the knop. It has been found that for a given apparatus and setting the ratio:

$$\frac{\text{resultant count} - \text{foundation count}}{\text{effect yarn count}}$$

is usually approximately constant and is dependent upon the yarn feed path. In one experimental apparatus this ratio was found to be about 1.8–2.0.

Of course, if desired, the knop yarn of this invention can be produced on an ordinary or fancy twisting frame starting with an already-spun foundation yarn. In this case the effect yarn is fed onto the foundation yarn between the feeding rollers of the frame and the twisting spindle. Nevertheless, where reference has been made in the foregoing specification to foundation and effect yarns, the term "yarn" in this context has been used merely for brevity and convenience, and it will be realized that the use of this term is not intended to imply that the strand supplied at the feed system or drafting rollers is necessarily already in the form of a previously spun yarn or that the invention is restricted to this special case.

What I claim is:

1. A method of producing a knop yarn comprising the steps of:

supplying an untwisted first fibrous strand to a drafting device;

drafting said first strand in said device;

drawing said drafted first strand from said drafting device onto a twisting spindle thereby spinning it to form a foundation yarn on said spindle;

supplying a second fibrous strand under tension to said first strand between said drafting device and said twisting spindle and causing it to be wound about said first strand while said first strand is spun into yarn;

and adjusting said tension until said second strand oscillates with respect to said first strand and forms thereon intermittent knops of effect yarn comprising layers of said second strand.

2. A method according to claim 1 wherein said tension is adjusted to cause three oscillations of said second strand in each spaced location whereby knops are formed having three layers of effect yarn wound about said foundation yarn.

3. A method according to claim 1 including the step of:

introducing into said first fibrous strand during drafting a fibrous reinforcing strand whereby said foundation yarn when formed is a core yarn.

4. A method according to claim 1 wherein said second fibrous strand is fed onto said first strand in a direction substantially at right angles thereto.

* * * * *